US006081946A

United States Patent [19]

Kennedy

[11] Patent Number: 6,081,946

[45] Date of Patent: Jul. 4, 2000

[54] APPARATUS FOR ACCOMMODATING VARIOUSLY SIZED HEADBOARDS AND FOOTBOARDS

[76] Inventor: Glen Kennedy, P.O. Box 1862, Greenville, S.C. 29640

[21] Appl. No.: 09/216,205

[22] Filed: Dec. 18, 1998

[51] Int. Cl.[7] ..... A47C 19/00

[52] U.S. Cl. ..... 5/200.1; 5/201; 5/286

[58] Field of Search ..... 5/200.1, 279.1, 5/282.1, 285, 286, 53.1, 201

[56] References Cited

U.S. PATENT DOCUMENTS

| | | | |
|---|---|---|---|
| Re. 29,611 | 4/1978 | Lawrence | 5/200.1 |
| 1,229,168 | 6/1917 | McTimmonds . | |
| 2,567,619 | 9/1951 | Rosenfeld | 5/200.1 X |
| 3,869,738 | 3/1975 | Lawrence | 5/200.1 |
| 4,169,294 | 10/1979 | Harris | 5/200.1 |
| 4,196,484 | 4/1980 | Harris | 5/201 |
| 4,501,033 | 2/1985 | Kessel et al. | 5/282.1 X |
| 4,856,127 | 8/1989 | Lenger . | |
| 5,012,538 | 5/1991 | Timm | 5/201 |

*Primary Examiner*—Terry Lee Melius
*Assistant Examiner*—Robert G. Santos
*Attorney, Agent, or Firm*—Hardaway/Mann IP Group

[57] ABSTRACT

A bed frame for accommodating a decorative piece is described, the bed frame comprising a first side rail, a second side rail opposite the first rail, at least one cross arm extending from the first rail to the second rail, and at least one upright member in communication with the cross arm, whereby, the bed frame can accommodate variously sized headboards and footboards on the cross arm member.

6 Claims, 3 Drawing Sheets

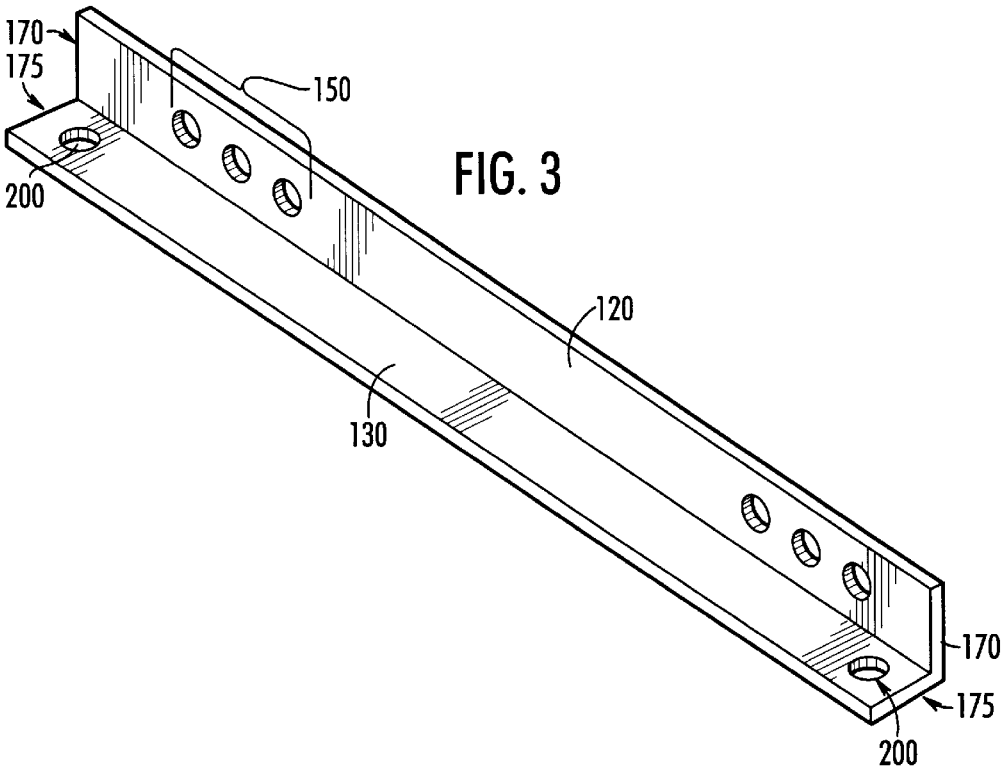
FIG. 3
FIG. 4
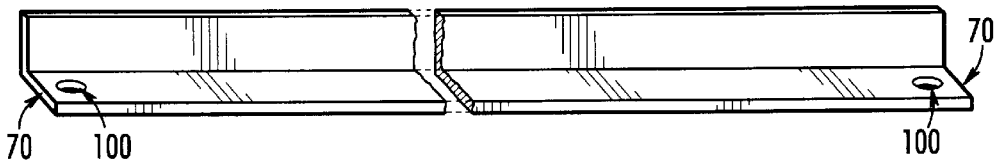
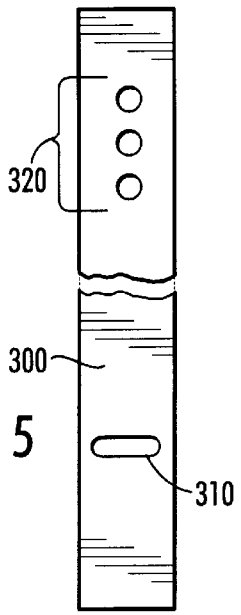
FIG. 5

APPARATUS FOR ACCOMMODATING VARIOUSLY SIZED HEADBOARDS AND FOOTBOARDS

FIELD OF THE INVENTION

This invention relates generally to bed frames and more particularly to a bed frame which can accommodate headboards and footboards of varying sizes.

BACKGROUND OF THE INVENTION

It has been found, particularly in the antique furniture business, that the dimensions of antique beds will not allow the use of modern day box springs and mattresses. As a result special sizes must be made to order. This bed frame, however, makes it possible to use modern day box springs and mattresses hence saving the necessity of special orders along with saving modifications to the original bed.

U.S. Pat. No. 1,229,168 to McTimmonds discloses a bed frame which can be transformed from a double to a single bed. U.S. Pat. No. 4,856,127 to Lenger discloses an expandable head board for varying sized spring and mattress assemblies. Neither reference, however, discloses a means for accommodating variously sized headboards to a bed frame. Thus, there is room in the art for improvement.

SUMMARY OF THE INVENTION

The present invention overcomes the problems and disadvantages of conventional bed frame configurations by providing a bed frame configured to accommodate headboards of varying sizes and shapes to fit a standard bed frame.

It is, thus, an object of the present invention to provide a novel bed frame for accommodating variously sized headboards and/or footboards. This, and other objects, are accomplished by providing a bed frame for accommodating a decorative piece, comprising a first side rail, a second side rail opposite the first rail, at least one cross arm extending from the first rail to the second rail, and at least one upright member in communication with the cross arm, whereby, the bed frame can accommodate variously sized headboards and/or footboards on the cross arm member.

BRIEF DESCRIPTION OF THE DRAWINGS

FIG. 3 is an elevation view of a bed frame cross-arm of the present invention.

FIG. 4 is an elevation view of a bed frame rail of the present invention.

FIG. 5 is an elevation view of an upright member for connection the headboard and/or footboard to the bed frame cross-arm.

DETAILED DESCRIPTION OF THE INVENTION

Figure 1:
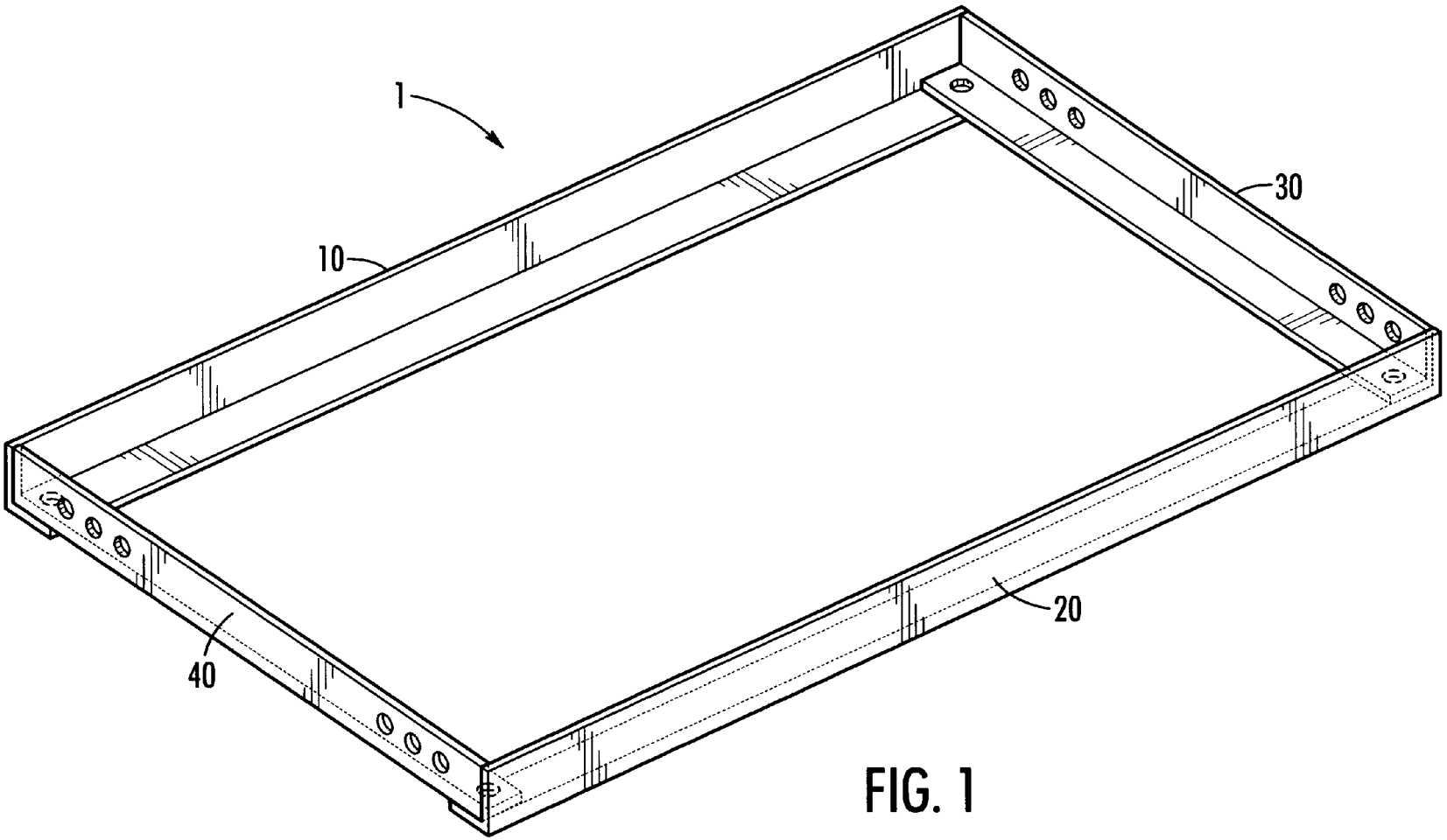
FIG. 1 is an elevation view of the bed frame of the present invention.

The preferred embodiment of the present invention, as shown in FIG. 1 of the drawings, shows a standard bed frame 1 having a first rail 10 and a second rail 20 opposing and running parallel to each other. The first rail 10 and second rail 20 are sized to fit any standard mattress, such as a single, double, queen or king sized mattress. The bed frame 1 also has a first cross-arm 30 and a second cross-arm 40 which are perpendicular to the first rail 10 and second rail 20 and are also opposite each other. First cross-arm 30 and second cross-arm 40 are sized to extend the width of a standard sized mattress, such as a single, double, queen or king sized mattress. Additional support structures (now shown) may also be provided. For example, support structures may be extended from first rail 10 to second rail 20 to provide additional support to the mattress/box spring combination.

Figure 2:
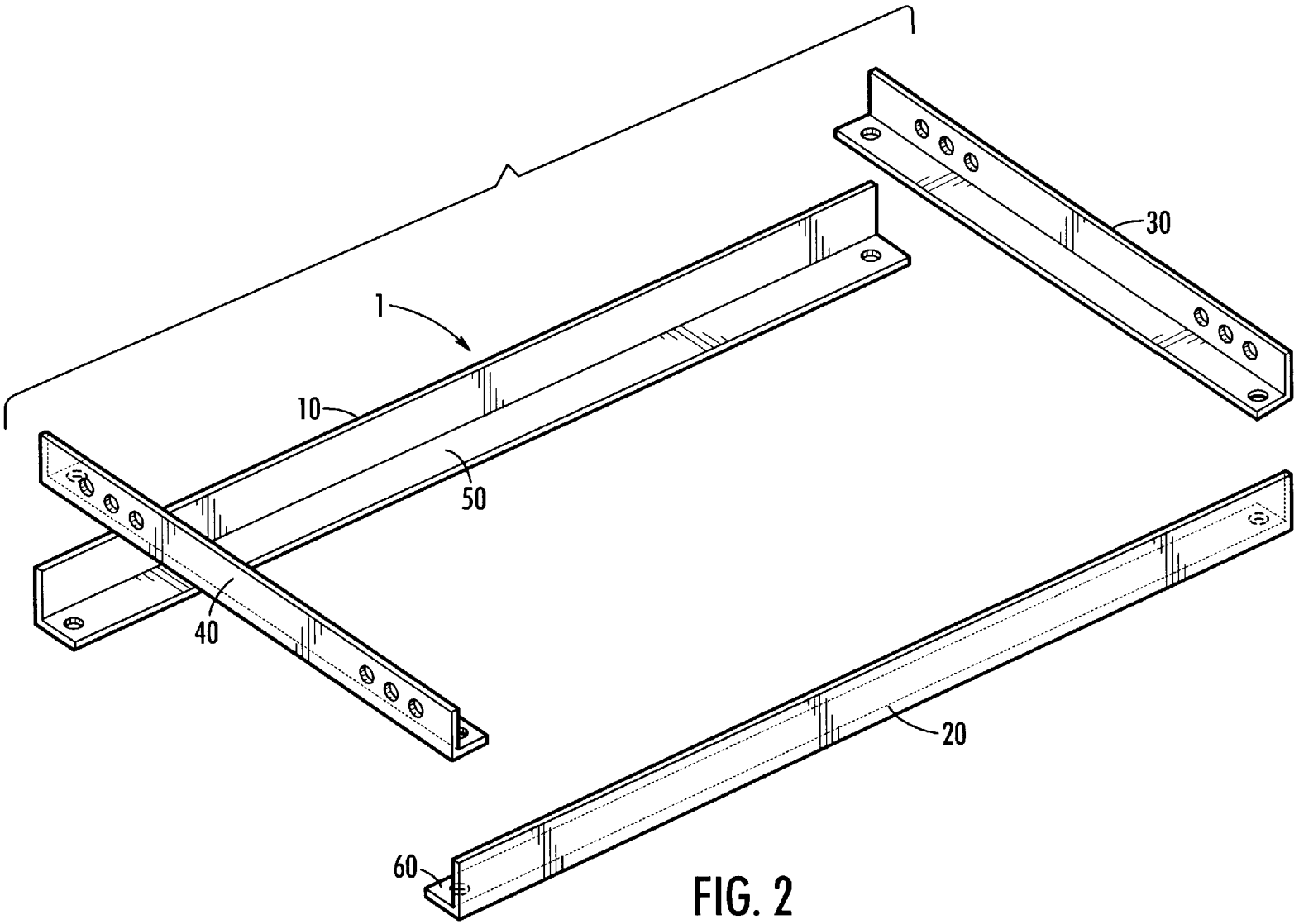
FIG. 2 is an exploded view of the bed frame of the present invention.

A more detailed description of the bed frame 1 can be seen in FIGS. 2 through 5. As seen in FIGS. 2 and 4, first rail 10 and second rail 20 are preferably "L" shaped members, the horizontal portion of the "L" shape providing a ledge portion 50 and 60 for supporting a box spring and mattress set. The first rail 10 and second rail 20 are not limited, however, to being "L" shaped. The rails may be any shape which would accommodate a box spring and mattress set, for example, the rails may be semi-circular. Additionally, in a preferred embodiment, the first rail 10 and second rail 20 are one integral piece. However, the rails may be a combination of pieces as long as the combination will perform the desired function of the bed rails.

As shown in FIG. 4, first rail 10 and second rail 20 define apertures 100 at or near edge 70 of the ledge portion 50 and 60. The apertures 100 are preferably round and threaded. However, the apertures 100 may take on any dimensions in accordance with the type of fastener desired to be used, for example, a bolt, or screw.

As further shown in FIG. 3, first cross-arm 30 and second cross-arm 40 define apertures 200 at or near each edge 175 of horizontal ledge 130. Cross-arm 30 and cross-arm 40 further define a set of apertures 150 at or near each edge 170 of the vertical ledge portion 120. The set of apertures 150 preferably comprises three apertures spaced approximately one inch apart. Fewer or more than three apertures may be used, however, and the spacing between the apertures may be varied in accordance with manufacturing needs. The set of apertures 150 are preferably round and threaded. However, the set of apertures 150 may take on any dimensions in accordance with the type of fastener desired to be used, for example, a bolt, or screw.

In order to assemble the bed frame 1 as seen in FIG. 1, apertures 100 of first rail 10 and second rail 20 are secured in communication with apertures 200 of first cross-arm 30 and second cross-arm 40 such that the horizontal ledge portions 50, 60 and 130 all face inward toward the center area of the bed frame 1. Upon assembling the bed frame 1, at least two upright members 300, shown in FIG. 5, are secured to the bed frame 1 to accommodate the headboard and/or footboard that is to be attached to the bed frame 1.

Upright member 300 defines a slotted aperture 310 as well as a set of preferably rounded and threaded apertures 320. As noted above, the apertures 310 and 320 may take on any form which will accommodate the fastener to be used, such as a screw, a bolt, etc. Slotted aperture 310 of an upright member 300 is placed in communication with an aperture in the set of apertures 150 located on the vertical portion 120 of the first and second cross-arms 30 and 40. Aperture 310 is slotted such that the upright member 300 may slidably adjust to accommodate at least one aperture of the set of apertures 150 such that the bed frame 1 can accommodate a headboard and/or footboard of varying sizes. In a preferred embodiment, apertures 320 are round and threaded, but they are not limited as such. Apertures 320 of an upright member 300 are aligned with the headboard and/or footboard such that the upright member 300 is secured to the headboard and/or footboard at apertures 320, the upright member 300 being further secured or in communication with the one of the cross-arms 30 or 40 at slotted aperture 310.

It is, thus, seen that a novel bed frame is provided. It is also seen that a novel bed frame for accommodating variously sized headboards and/or footboards has been provided. Many variations of the present invention will become apparent to those skilled in the art from a reading of the above description and such variations are embodied within the spirit and scope of the present invention s measured by the following appended claims.

What is claimed is:

1. A bed frame for accommodating a decorative piece, comprising:

a first side rail;

a second side rail opposite said first rail;

at least one cross arm extending from said first rail to said second rail, wherein said at least one cross arm comprises an "L" shaped member having a horizontal section and a vertical section, said horizontal section and said vertical section in communication with each other along a ledge portion, wherein said at least one cross arm defines a set of apertures in said vertical section of said "L" shaped member, whereby a decorative piece may be attached to the bed frame; and, at least one upright member in communication with said at least one cross arm, whereby, said bed frame can accommodate variously sized headboards and footboards on said at least one cross arm by said at least one upright member.

2. The bed frame of claim 1, wherein said set of apertures comprises at least two apertures.

3. The apparatus according to claim 1 wherein said first and second side rails each comprise a horizontal section and a vertical section in communication with each other along a ledge portion, said horizontal sections each defining a set of apertures, and said at least one cross arm defines a set of apertures in said horizontal section of said at least one cross arm.

4. A bed frame for accommodating a decorative piece, comprising:

a first side rail having a first end and a second end, said first side rail defining apertures at both said first end and said second end of said first rail;

a second side rail opposite said first side rail having a first end and a second end, said first side rail defining apertures at both said first end and said second end of said second side rail;

at least one cross arm extending from said first rail to said second rail, said at least one cross arm defining apertures which correspond to said apertures on said first rail and said second rail; and, at least one upright member in communication with said at least one cross arm, said at least one upright member defining a slotted aperture in communication with said apertures on said at least one cross arm, whereby, said bed frame can accommodate variously sized headboards and footboards on said at least one cross arm by said at least one upright member.

5. The bed frame according to claim 4, wherein said first side rail has a horizontal portion and a vertical portion, said second side rail opposite said first side rail has a horizontal portion and a vertical portion, and said at least one cross arm has a horizontal portion and a vertical portion.

6. A bed frame for accommodating a decorative piece, comprising:

a first side rail having a first end and a second end, said first side rail defining apertures at both said first end and said second end of said first rail;

a second side rail opposite said first side rail having a first end and a second end, said first side rail defining apertures at both said first end and said second end of said second side rail;

at least one cross arm extending from said first rail to said second rail, said at least one cross arm defining apertures which correspond to said apertures on said first rail and said second rail; and, at least one upright member in communication with said at least one cross arm, said at least one upright member defining a slotted aperture in communication with one or more of said apertures on said at least one cross arm, whereby said bed frame can accommodate variously sized headboards and footboards on said at least one cross arm by said at least one upright member.

* * * * *